United States Patent [19]

Eakins

[11] 4,358,205

[45] Nov. 9, 1982

[54] BLENDING SYSTEM

[76] Inventor: Raymond L. Eakins, 515 E. Broadway, Keota, Iowa 52248

[21] Appl. No.: 243,550

[22] Filed: Mar. 13, 1981

[51] Int. Cl.[3] ..... B01F 5/24; B01F 13/10

[52] U.S. Cl. ..... 366/141; 366/150; 366/154; 366/186; 366/337; 366/341; 366/9

[58] Field of Search ..... 366/8, 16, 18, 131, 366/141, 41, 49, 186, 189, 341, 17, 19, 154, 9, 14, 15, 27, 336, 337, 603; 414/268, 269

[56] References Cited

U.S. PATENT DOCUMENTS

| | | | |
|---|---|---|---|
| 3,314,557 | 4/1967 | Sackett, Sr. | 366/186 X |
| 3,337,190 | 8/1967 | Dettmer | 366/154 X |
| 3,395,898 | 8/1968 | Westelaken | 366/141 |
| 3,603,567 | 9/1971 | Sackett, Sr. | 366/141 |
| 3,977,657 | 8/1976 | Shearer et al. | 366/341 |
| 4,089,509 | 5/1978 | Morton et al. | 366/8 |

*Primary Examiner*—Philip R. Coe
*Assistant Examiner*—Joseph M. Pitko
*Attorney, Agent, or Firm*—Hugh D. Jaeger

[57] ABSTRACT

Blending system comprising batch hopper with a scale, a blend hopper positioned directly below the batch hopper, an upwardly running conveyor running the full length of the blending hopper to the top of a surge bin, an upwardly running discharge conveyor running from the bottom of the surge bin to the top of a holding bin, and a holding bin for holding several batches of material. The batch hopper, the first of four hoppers, rests on a scale and includes a plurality of baffles positioned to control material which is dumped into the hopper such as by a front-end loader. A set of doors on the bottom of the batch hopper dumps the material directly below into a blending hopper which holds the contents of the batch hopper and includes a baffle for further blending of the material. A conveyor runs the entire length of the blend hopper and transfers material upwardly to a surge bin. The surge bin has baffles to eliminate any concentration of materials and disperse them throughout the material. The upwardly moving discharge conveyor moves the material from the surge bin into a holding bin. The holding bin holds several batches of material and has a plurality of baffles providing for final blending of material, eliminating any concentrations. The blending system requires less time and energy for blending of materials and only has two moving components, the conveyors and the doors of the batch hopper.

4 Claims, 7 Drawing Figures

BLENDING SYSTEM

BACKGROUND OF THE INVENTION

1. Field of the Invention

The present invention relates to mixing and dispensing equipment and, more particularly, pertains to a blending system for blending of dry materials such as fertilizer in the agricultural environment.

2. Description of Prior Art

The prior art blending systems consist of four parts including a batch hopper, two conveyors or augers, and a rotary mixer. The batch hopper consists of a hopper resting on a scale which substantially approximates the same volume as the rotary mixer. The batch hopper is utilized to measure the various dry ingredients, and when a batch is complete, the conveyor is started and the material is moved into the mixer. The mixer is substantially constructed similar to a cement mixer and the material is moved into the mixer, rotated a few minutes, and then the mixer drum is reversed in an opposite direction, the material is discharged onto a second conveyor for conveying to the point of discharge. Sometimes the batch hoppers may not have a scale and the material is then measured either by bulk, on a front-end loader by volume, or by individual bags which is less than desirable and time consuming.

Another type of prior art device is a blending tower which blends material, usually only two materials, through gravity feed but which is less than desirable as there are usually high concentrations of materials which are not blended and result in uneven blend of materials as well as concentrations of unmixed materials.

Another prior art device is the screw conveyor mixer where materials are put into a blender and rotatable augers are positioned inside the blender which when rotated move the material from one end to the other end of the blender. The blend is then discharged onto a conveyor or other loading device for loading onto a vehicle.

All of the prior art devices require considerable energy in the form of horsepower to move the material, considerable time, and a resultant consumption of electricity per unit which is large. Electric motors are usually required to move the drum mixers or screw augers in addition to the conveyors, all resulting in consumption of kilowatt hours which becomes more expensive due to rising rates of fuel. Further, considerable time is required in the mixing process, which means that other batches cannot be mixed until the first batch is moved or transported to either a holding facility or to the end point such as the bed of a dump truck, spreader truck, etc. Further, the prior art has considerable moving parts which require continued maintenance due to the abrasive and corrosive nature of the material which is usually fertilizer or a like substance. Moving parts not only consume energy but also require maintenance resulting in additional expense.

The present invention overcomes the disadvantages of the prior art by providing a gravity flow system through baffle cells in addition to having a least number of moving components, thereby requiring least maintenance and consumption of energy.

SUMMARY OF THE INVENTION

The general purpose of the present invention is a blending system to blend dry materials comprising a batch hopper connected with a scale, a blend hopper positioned substantially beneath the batch hopper, a first conveyor running the entire length of the blend hopper upwardly to a surge bin, a surge bin having baffles, discharge conveyor running from the surge bin upwardly to a holding bin, and the holding bin having baffle cells. The blending system provides maximum blending with least consumption of energy and only has two moving components, the two conveyors and the doors below the batch hopper.

The blending system is particularly intended for agricultural use and the blending of fertilizer.

According to one embodiment of the present invention, there is provided a blending system for blending a plurality of dry materials, the blending system comprising a hopper including a scale for measuring rate of dry materials and a blend hopper substantially positioned below the hopper, doors positioned in the hopper for discharging material into the blend hopper, a first upwardly moving conveyor extending along the longitudinal length of the blending hopper and up to a surge bin, an upwardly moving discharge conveyor from the bottom of the surge bin to the top of a holding bin, and a plurality of doors at the bottom of the holding bin for discharging blended material into a vehicle bed, a vehicle spreader or like transportation equipment. The batch hopper, blend hopper, surge bin, and holding bin are provided with baffles for appropriately blending the material through gravity feed of finite sections of cross sectional areas of material.

A significant aspect and feature of the present invention is a blending system with least movable components and consuming a least amount of energy, especially over those of the prior art devices. The blending system of the present invention requires motorized drive of two conveyors in addition to movable doors between the batch hopper and the blend hopper. All blending, mixing and dispensing of material occurs through gravity feed thus eliminating the mixing drums, mixers, augers, and screw conveyors of the prior art devices and wasted energy.

Another significant aspect and feature of the present invention is a blending system which particularly runs itself for use by the individual farmer, the small cooperative, the fertilizer company itself, or any other small to large concerns requiring fertilizer blenders. The blending system can be physically sized according to the quantity of the batch to be mixed when the alternative economies provide that a plurality of systems can be used. In the alternative, a plurality of conveyors can feed large-sized surge bins or hoppers as dictated by a user's requirements.

Having thus described one embodiment of the present invention, it is a principal object hereof to provide a blending system for blending, mixing and dispensing dry materials such as fertilizer or like material.

An object of the present invention is to provide a blending system which requires least time and energy for mixing a batch of material and a system which requires least maintenance having the least number of moving components.

Another object of the present invention is to provide a blending system for blending a batch of dry materials which are weighed by weight or weighed by volume in a batch hopper, and then discharged substantially below into a blend hopper. Gravity feed of the dry material provides for blending of the parts of the material through cross-sectional areas of the material positioned in the hoppers including the batch hopper, blend hopper, surge bin and the holding bin. More specifically, the first conveyor removes cross-sectional areas from the blend hopper and the second discharge conveyor removes cross-sectional areas from the surge bin. Combination of gravity feed and removing the material in cross-sectional areas further blends the material, providing for consistent concentration throughout the batch.

A further object of the present invention is to provide a blending system that while transporting a first batch from the blend hopper to the holding bin, a second batch can immediately be compounded while the first batch is being transported through the hopper, surge and holding conveyor bin system. The physical size of the components of the bins, conveyors and hoppers is dictated by an individual's requirements and can be easily varied within the system without requiring changes to the other components of the system. For example, the size of the holding bin can be increased or decreased in size without changing the other components of the system. The discharge conveyor can also be made movable to feed more than one holding bin for holding different compounds of dry materials such as different concentration or mixtures of fertilizer.

An additional object of the present invention is to provide a blending system which uses least energy depending on gravity and cross-sectional area combining of a plurality of cross-sections.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference numerals designate like parts throughout the figures thereof and wherein.

DESCRIPTION OF PREFERRED EMBODIMENTS

Figure 1:
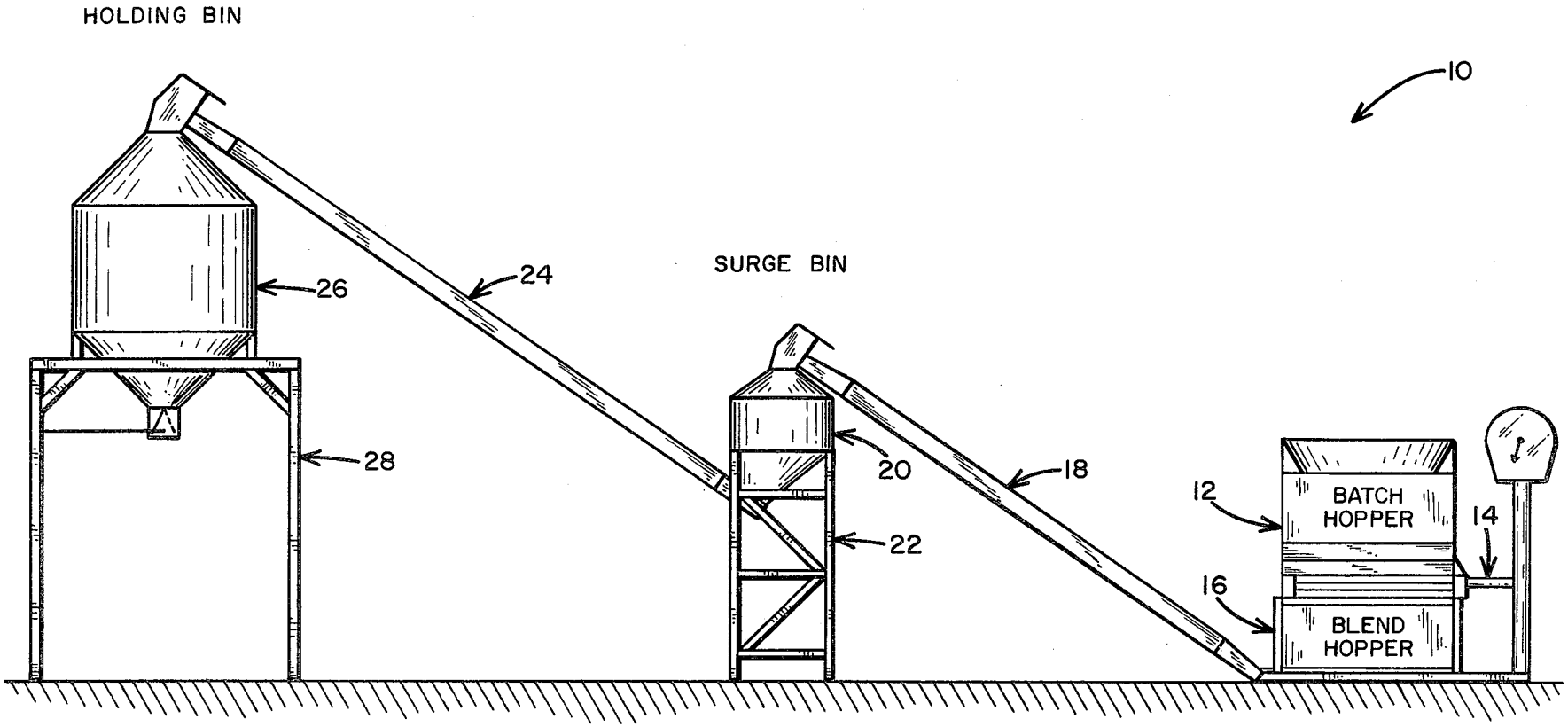
FIG. 1 illustrates a plan view of a blending system, the present invention.

FIG. 1, which illustrates a plan view of a blending system 10 of the present invention, illustrates a batch hopper 12 positioned above a scale 14. The scale 14 weighs material in the batch hopper 12. A blend hopper 16 positioned substantially below the batch hopper 12 is separated therefrom by a plurality of doors 98-102 of FIG. 3. A first conveyor 18 extends along the longitudinal length of the blend hopper 16, upwardly into the top of a surge bin 20. The surge bin 20 is elevated on a structure 22. A discharge conveyor 24 extends upwardly from the bottom of the surge bin 20 to the top of a holding bin 26. The holding bin is elevated on a structure 28 having a height which permits a vehicle to drive underneath for loading.

Figure 2:
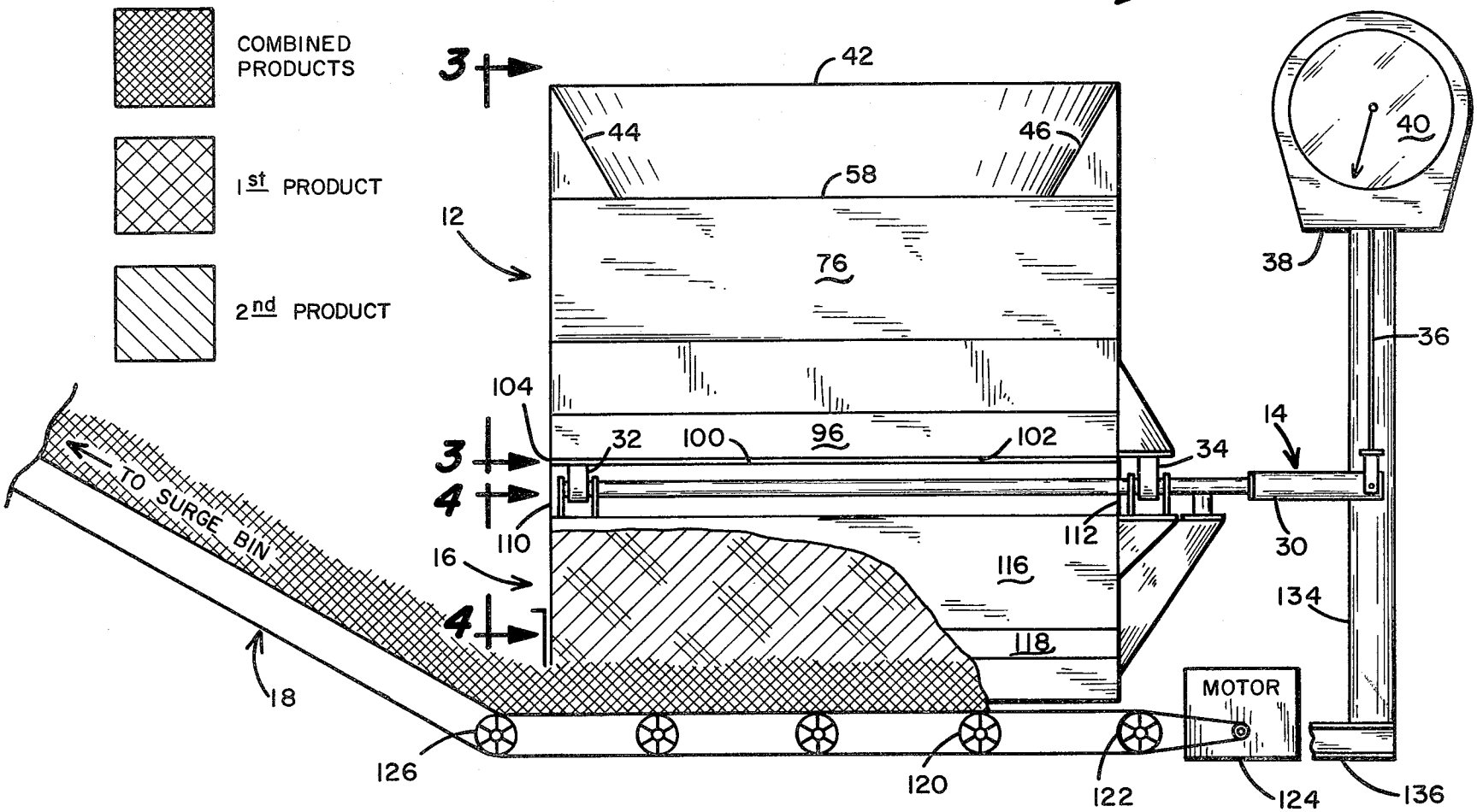
FIG. 2 illustrates an enlarged view of a batch hopper, the scale, and a blend hopper with a conveyor positioned below the blend hopper.
Figures 3, 4:
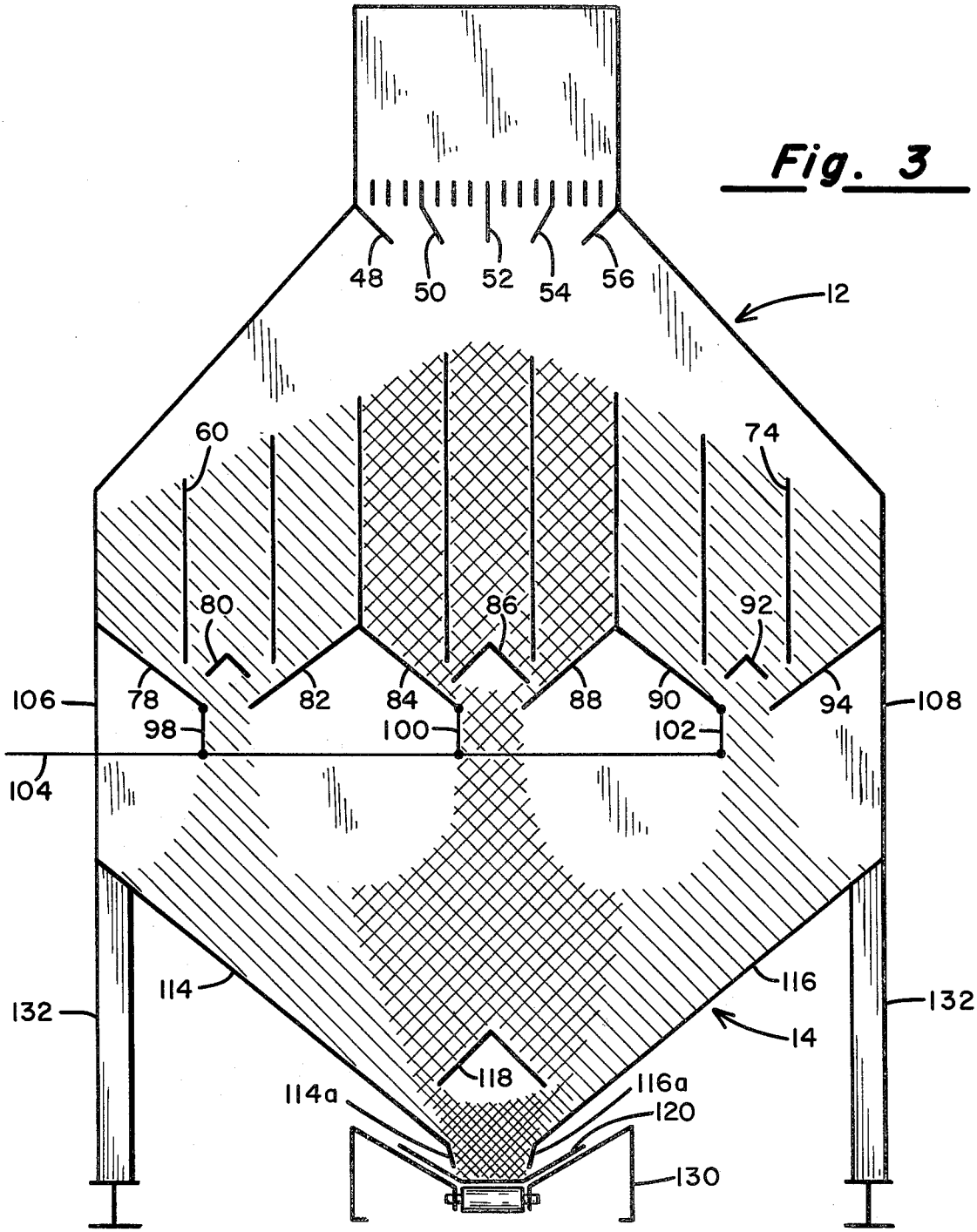
FIG. 3 illustrates a sectional view taken along line 3—3 of FIG. 2 of the batch hopper.
FIG. 4 illustrates a sectional view taken along line 4—4 of FIG. 2 of the blend hopper.

FIG. 2, which illustrates a side view of the batch hopper 12, the scale 14, and the blend hopper 16, shows a pivot arm scale 14 including a pivoting arm 30 between load points 32 and 34 of the batch hopper 12, a connecting arm 36, and scale mechanism 38 including the scale dial 40. The batch hopper 12 includes an upper loading rectangular end 42 having slanted side members 44 and 46. A plurality of baffles 48-56 is provided as illustrated in FIG. 3 at the level 58 in FIG. 2. A second plurality of baffles 60-74 as illustrated in FIG. 3 is provided at the level 76 as illustrated in FIG. 2. A third plurality of baffles 78-94 is provided at level 96 as illustrated in FIG. 2 of the batch hopper. Doors 98, 100 and 102 being double hinged to baffles 78, 84 and 90 respectively and connecting member 104 provide for discharge of the dry material from the batch hopper 12 to blend hopper 16 when simultaneously operated. Member 104 is suitably latched to close the doors when loading material and unlatched to discharge the material from the batch hopper 12. While illustrated in FIG. 3, side members 106 and 108 can be provided for enclosing the hoppers 12 and 14 providing for a dust free and enclosed OSHA approved system. Likewise end plates would be provided, 110 and 112 as illustrated in FIG. 2. The blend hopper 16, as also illustrated in FIG. 4, shows side members 114 illustrated in FIG. 3 and 116 illustrated in FIG. 2, and forming lips at the bottom thereof respectively as illustrated in FIG. 4 and an internal baffle 118 having an inverted V-shape. Conveyor 18 includes a conveyor belt 120 riding about drive sprocket 122 driven by motor 124 and extends upwardly at drive sprocket 126 of roller sprocket 128 of FIG. 5. The conveyor belt 120 forms a V-shape about roller 130 as illustrated in FIG. 4 which supports the drive roller 122 and other rollers as required about the length of the conveyor but not numbered for purposes of clarity in the drawings.

FIG. 3 illustrates a sectional view taken along line 3—3 of FIG. 2 and shows a side view of the batch hopper 12 where all numerals correspond to those elements previously described. Particular attention is drawn to the crosshatching and hatching of the products showing the gravity mixing of the material in the bins due to the gravity feed and cross-sectional area mixing during the gravity feed process. Particular attention is pointed to the three levels of baffles; the first level being 48-56, the second level 60-74, and the third level being 78-94 on levels 58, 76 and 96 respectively. These longitudinally positioned baffles provide for a cross-sectional area of mixing through gravity feed at discharge.

FIG. 4, which illustrates a sectional view taken along line 4—4 of FIG. 2, shows the blend hopper 16 where all numerals correspond to elements previously described. The inverted V-baffle 118 provides for mixing at combined product exits through gravity feed about the baffle 118 at the lips **114*a* and 116*a* of the sides of the blend hopper 16 at the conveyor 120. The batch hopper 12, scale 14, and the blend hopper 16 are supported on vertical standing members 132. The scale is also supported on a vertical standing member 134 and base 136**.

Figure 5:
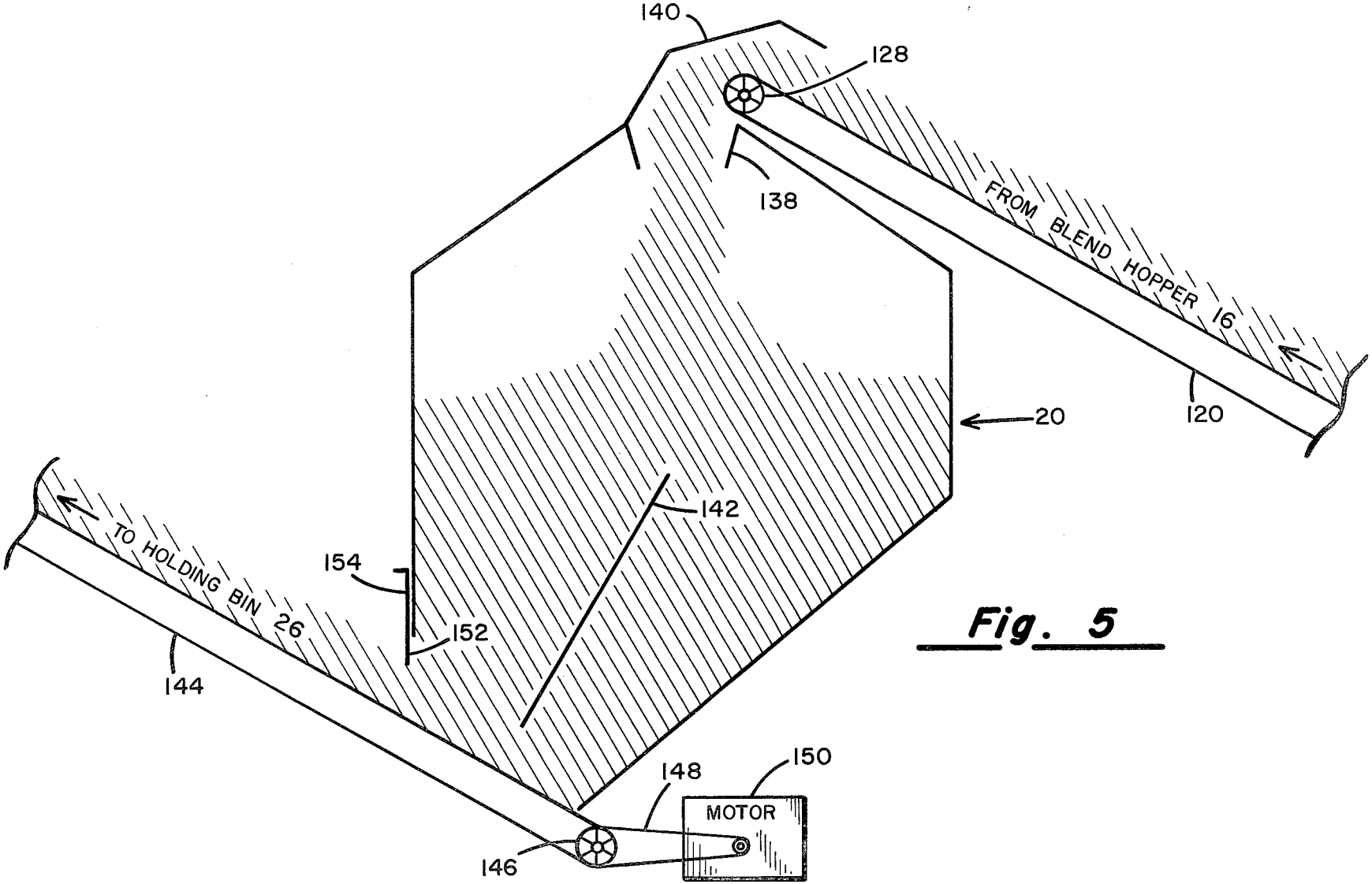
FIG. 5 illustrates a cross-sectional view of the surge bin.

FIG. 5, which illustrates the surge bin 20 shows the conveyor belt 120 winding around the free roller 128 and carrying product into the entrance of the bin 138 about a cover member 140 providing for a dust-free OSHA approved environment. The surge bin, by way of example and for purposes of illustration only, is a hexagonal shaped bin having a baffle 142 positioned inside for division of product. The discharge conveyor 144 riding about driven roller 146 by belt 148 connected to motor 150 removes product in cross-sectional areas from the back of the bin between the belt 144 and lip 152 having a slidable door 154 for closing off said surge bin as required.

Figure 6:
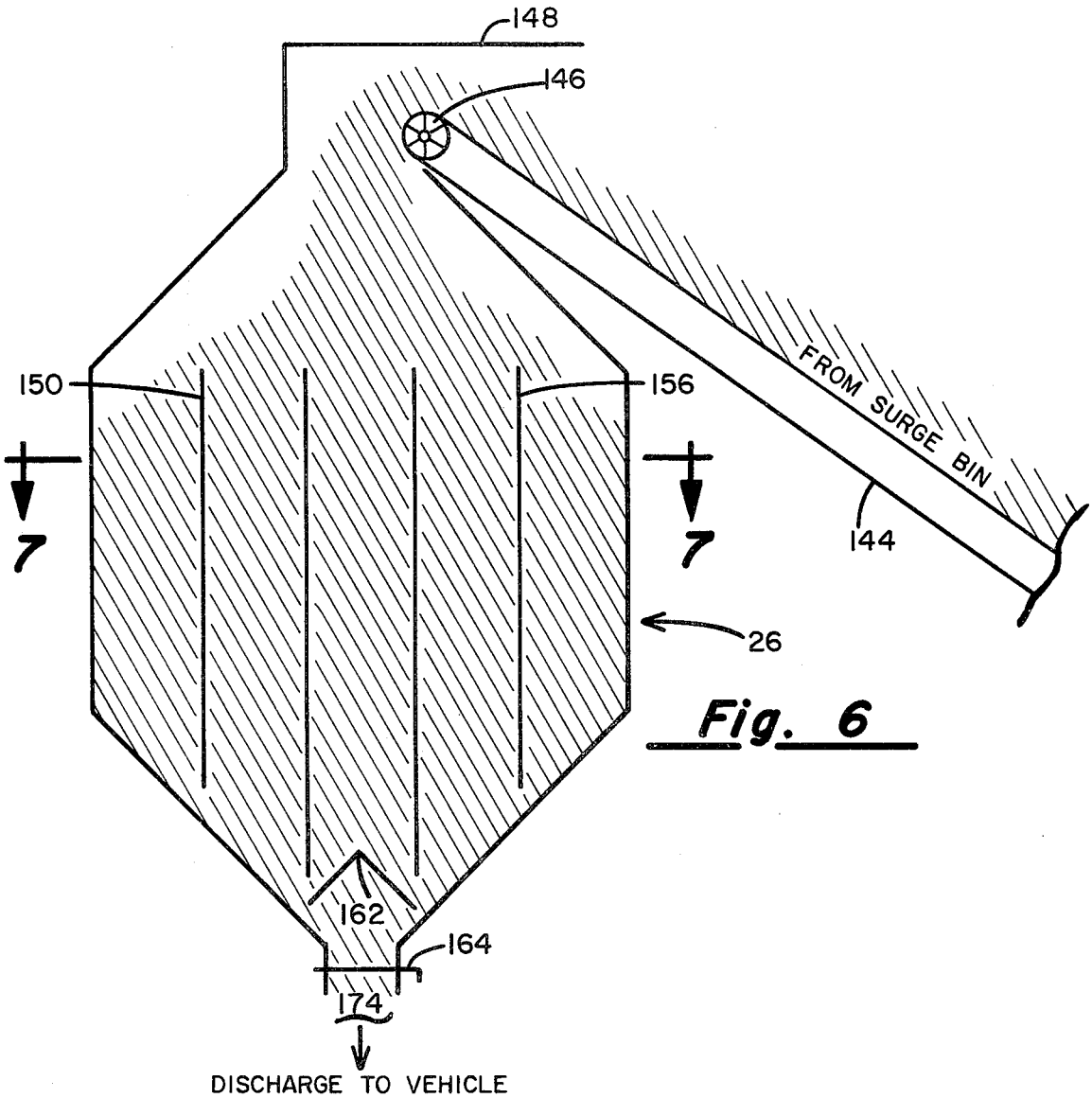
FIG. 6 illustrates a cross-sectional view of the holding bin.
Figure 7:
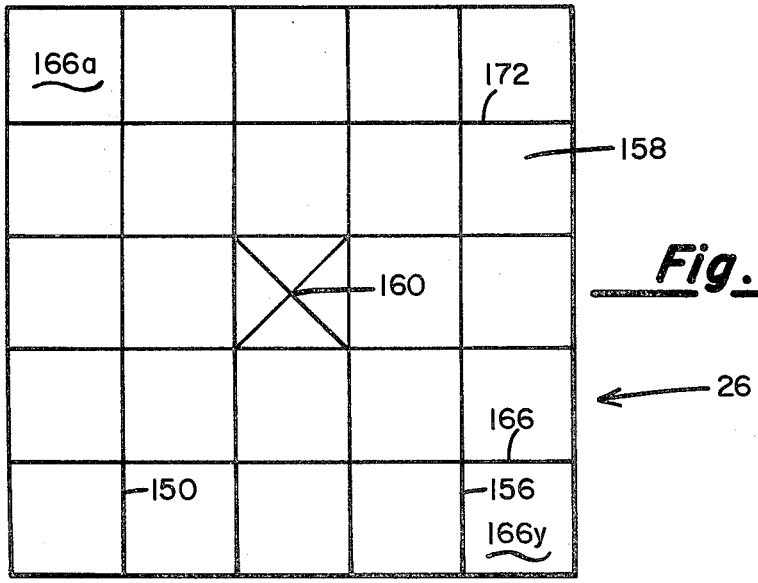
FIG. 7 illustrates a sectional view taken along line 7—7 of FIG. 6.

FIG. 6, which illustrates a cross-sectional view of the holding bin 26, shows a conveyor belt 144 winding about pulley 146. The holding bin 26 is an octagonal member with the top and bottoms open, by way of example and for purposes of illustration only, and including a dust shield 148 providing for an OSHA approved dustless environment. A plurality of baffles 150-156 illustrated in cross-sectional in FIG. 7 positioned in a cellular arrangement 158 as illustrated in FIG. 7 including a crossed cell in the center 160 which provides for final blending and mixing in the system prior to discharge about an inverted V-shaped baffle 162 in the bottom of the holding bin as illustrated in FIG. 6. A slidable door 164 or other suitable structure can be provided for discharging of blended material into a vehicle or other like structure such as a spreader, dump truck, or other means of transportation.

FIG. 7, which illustrates a sectional view taken along line 7—7 of FIG. 6, shows the cellular members of the holding bin providing for 25 rectangular cells 166*a* through 166*y* including crossed cell 160. The structure provides for final blending and mixing for distributed concentration of dry materials in the holding bin 26 prior to discharge.

PREFERRED MODE OF OPERATION

The blending system 10 comprises the four hoppers 12, 16, 20 and 26, the two conveyors 18 and 24, and the scale 14. The batch hopper 12 is positioned on the scale 14 at low points and includes a top plurality of baffles 48-56 such that as the material such as fertilizer is dumped in the front-end loader, the material loads from the center of the hopper and then toward the edges. Baffles 48-56 control the material as it comes in and allows it to discharge over constant time. An operator adds the predetermined quantities or weights of material such as fertilizer in desired proportions using the scale as a measuring device, or the material can be added by volume. The materials are stored in between the baffles 60-74 in vertical columns.

Once all materials are placed in the batch hopper 12, the doors 98-102 are opened at the bottom of the hopper and the material falls quickly from the batch hopper 12 into the blending hopper 16 through the doors which are sized in direct ratio to the volume of material above each door. Once the doors are closed, the operator is now free to start mixing the next batch in the batch hopper 12.

Materials now in the blending hopper, which is designed to hold the entire contents of the batch hopper 12 which forces the material in the center of the blend hopper 16 to the sides of the hopper, then blends with the material at the sides of the hopper. The material from the sides of the hopper are allowed to move back to the center of the hopper through gravity feed and is removed by the longitudinal conveyor belt 120 which runs the entire length of the blend hopper 16. As in the batch hopper 12 as well as the blend hopper 16, cross-sectional areas are being moved through gravity feed.

The baffles in the blending hopper force the conveyor 120 to unload the blending hopper 16 starting at the end opposite to the direction of travel which unloads cross-sectional areas of the material in the blending hopper upwards to the surge bin 20.

The surge bin is filled by the conveyor 18 and emptied with conveyor 24. The start of the discharge conveyor is the way to allow the surge bin to fill about 50% full before the discharge conveyor empties the surge bin. The surge bin 20 is designed to fill from the center, creating a pile in the bin thereby eliminating any concentrations of materials which may occur in dispersing the same over the top of the pile. The discharge conveyor 24 as well as the first conveyor 18 again unloads from the read end of the surge bin, further eliminating any concentrations and providing for consistency of blending and mixing of the dry materials throughout the batch. The discharge conveyor 24 moves the material from the surge bin 20 into the holding bin 26.

The holding bin 26 serves two primary functions, the first function being that it provides storage for several batches of material for flow to trucks or spreaders which are getting ready to load and then provides for quickly filling the same. The second primary function is a blending of any materials which is accomplished by construction of the vertical baffles in a cellular form including the center cell of an X configuration. The inverted V-member provides for each of the compartments to empty into a single area and discharge equally, providing for any final eliminations and consistency of concentrations of material at the point of discharge 174.

ALTERNATIVE EMBODIMENT

In an alternative embodiment, the surge bin 20 can also serve as the holding bin. The surge bin 20 can also have a circular cross-section and be supported on legs providing for vehicle loading at the bottom of the surge bin. Inherently, an extended conveyor would be required between the blend hopper and the top of the surge bin.

Various modifications can be made to the present invention without departing from the apparent scope thereof. The discharge conveyor 24 can be radially movable about a pivot point at the surge bin 18, and discharge to a plurality of hopper bins for storing different blends of blended materials. The surge bin and holding bins can have either rectangular cross-sections, or, more importantly, circular cross-sections.

Having thus described the invention, what is claimed is:

1. Blending system for blending a plurality of dry materials, said system comprising:

a. hopper means including a scale means for measuring weight of dry materials connected to said hopper means and three groups of longitudinal baffle means positioned in said hopper including first level substantially vertical baffles, second level vertical baffles and third level of inverted V members;

b. blend hopper means substantially aligned and below said hopper means, said blend hopper means including inwardly sloping sides and an inverted V-shaped baffle in a lower portion;

c. first conveyor means extending along and upwardly from said blend hopper means;

d. surge bin means including at least one ramped downward side positioned below said first conveyor means for eliminating any concentration of materials and including at least one baffle;

e. second conveyor means extending upwardly from said surge bin means; and, f. holding bin means of a substantially rectangular cross section including inverted triangular top and bottom sections secured to said rectangular cross section positioned below said second conveyor means for blending and holding mixed materials for loading and including door means in a bottom thereof, and including a plurality of vertically positioned cellular baffle members whereby said blending system minimizes time for blending and requires least energy for blending.

2. Blending system of claim 1 wherein said first conveyor means is positioned substantially below said blend hopper means and along an entire longitudinal length of said blend hopper means.

3. Blending system of claim 1 wherein said second conveyor means discharges material from said surge bin means to said holding bin means.

4. Blending system of claim 1 wherein said holding bin means includes a plurality of baffle means.

* * * * *